US011513476B2

(12) United States Patent
Kadmiri et al.

(10) Patent No.: US 11,513,476 B2
(45) Date of Patent: Nov. 29, 2022

(54) MUSICAL COMB FOR A TIMEPIECE STRIKING MECHANISM

(71) Applicant: Montres Breguet S.A., L'Abbaye (CH)

(72) Inventors: Younes Kadmiri, Morre (FR); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 883 days.

(21) Appl. No.: 16/291,000

(22) Filed: Mar. 4, 2019

(65) Prior Publication Data

US 2019/0286060 A1 Sep. 19, 2019

(30) Foreign Application Priority Data

Mar. 16, 2018 (EP) ..... 18162207

(51) Int. Cl.
*G04B 21/08* (2006.01)
*G10K 1/066* (2006.01)
*G10F 1/06* (2006.01)

(52) U.S. Cl.
CPC ..... *G04B 21/08* (2013.01); *G10F 1/06* (2013.01); *G10K 1/066* (2013.01)

(58) Field of Classification Search
CPC ..... G10K 1/066; G04B 21/08
USPC ..... 116/169
See application file for complete search history.

(56) References Cited

U.S. PATENT DOCUMENTS

| | | | | |
|---|---|---|---|---|
| 267,104 | A * | 11/1882 | Piguet | G04B 21/08 368/190 |
| 2,493,119 | A * | 1/1950 | Duncan | G10F 1/06 84/94.1 |
| 3,646,848 | A | 3/1972 | Matthey | |
| 4,676,135 | A * | 6/1987 | Kitazawa | G10D 9/035 984/142 |
| 2016/0306325 | A1* | 10/2016 | Karapatis | G10K 1/067 |

FOREIGN PATENT DOCUMENTS

| | | |
|---|---|---|
| CH | 498 463 | 10/1970 |
| CH | 704 670 A2 | 9/2012 |
| JP | 2001 -215956 | 8/2001 |

OTHER PUBLICATIONS

European Search Report dated Sep. 20, 2018 in Eropean Application 18162207.7, filed on Mar. 16, 2018 ( with English Translation of Categories of cited Documents).
Japanese Office Action dated Sep. 29, 2020 in Japanese Patent Application No. 2019-037241 (with English translation), 4 pages.

* cited by examiner

*Primary Examiner* — Daniel S Larkin
(74) *Attorney, Agent, or Firm* — Oblon, McClelland, Maier & Neustadt, L.L.P.

(57) ABSTRACT

A musical comb for a striking mechanism of a timepiece includes several tines connected to a heel for securing the comb inside the timepiece. The musical comb further includes grooves in the heel each extending into the extension of each space between the adjacent tines in order to eliminate any dissonance during actuation of the tines.

12 Claims, 3 Drawing Sheets

MUSICAL COMB FOR A TIMEPIECE STRIKING MECHANISM

CROSS-REFERENCE TO RELATED APPLICATION

This application claims priority to European Patent Application No. 18162207.7 filed on Mar. 16, 2018, the entire disclosure of which is hereby incorporated herein by reference.

FIELD OF THE INVENTION

The invention concerns an optimised musical comb for a timepiece striking mechanism.

The invention also concerns a method for making an optimised musical comb for a timepiece striking mechanism.

BACKGROUND OF THE INVENTION

In the field of horology, it is possible to provide a timepiece, such as a watch, with a striking mechanism capable of producing a sound or a melody at predetermined instants or on demand. To produce a melody, it is known to mount inside the striking mechanism a musical module having at least one musical comb. This musical comb is formed of several tines, which are generally all connected to the same base or heel for mounting on a fixed part of the timepiece, such as a bridge or a plate or a case middle for example. The tines are preferably rectilinear and parallel to each other in a same plane.

Normally, the length of a tine defines a specific note, when actuated by a corresponding actuation member of the musical module. The actuation member acts on a free end of the tine to make it vibrate so that it produces the defined note. Of course, it is also known to have several groups of parallel tines of the same length so that they produce the same musical note when actuated.

FIGS. 1*a* and 1*b* represent an embodiment of a conventional musical comb for a striking mechanism in a three-dimensional view and a top view. Musical comb 1 is in one piece. It includes a set of rectilinear tines 3 connected to a heel 2 for attachment particularly by means of screws (not represented) which pass through holes 5 in heel 2 of comb 1 inside a timepiece case. These tines 3 can be arranged parallel to one another in a same plane. The space between each tine 3 may be identical.

Each free end of tines 3 includes a cam 4, which forms a ramp. The ramp preferably defines a slope forming an acute angle relative to the free end of tine 3. To actuate at least one tine 3 of musical comb 1, there is provided an actuation member, such as a pin, which comes into contact with the ramp of cam 4 to raise or bend tine 3, when said actuation member moves in the direction of the free end of the tine. Once the actuation member has moved beyond said cam 4, tine 3 is released so that it vibrates and produces a determined note.

To facilitate manufacture of tines 3 of musical comb 1, a round or cylindrical milling cutter can be used across heel 2 of comb 1 to define a line P according to the length of the tines to be made. The length of the tines is calculated to obtain a specific frequency and the width and thickness of the tines are identical for all the tines. In this way and as seen in FIG. 1*b*, point A and point B are not symmetrical with respect to the bending plane of tine 3, and this causes the tine to twist, when the latter is bent by the passage of a pin. The bending energy is thus distributed in bending and torsion modes. Bending is no longer pure and thus the energy transmitted to the tine is not maximised in its first bending mode, which is the mode desired to be radiated.

The first natural bending mode of tine 3 is not properly actuated and dampening is more pronounced since tine 3 vibrates in bending and torsion modes. In these conditions, it is noted that there is a vibration transfer from an actuated tine 3 to another adjacent tine 3, since when the tine 3 to be actuated bends, a stress is produced at the point of attachment of tine 3 to heel 2. This stress may prestress the adjacent tines 3 if the latter are coupled to each other and thus produce undesired bending of such tines 3. Thus, when the pin passes over cam 4 at the free end of a tine 3, it actuates this tine 3 but also the adjacent tines 3. There is then sound interference in the melody, since instead of the pure sound produced by actuating a single tine 3, there may be two, three or four adjacent tines 3 vibrating at the same time, but at lower vibration amplitudes. Dissonance is therefore generated, and the sound is observed to be no longer as pure as desired, which constitutes a drawback of a musical comb of the prior art.

U.S. Pat. No. 3,013,460 discloses a musical comb with a certain number of tines, which are all connected to a heel in one piece with the tines. The comb may be fixed to a plate by screws, which pass through openings in a cover plate on the top of the heel, and openings in the heel. The thickness of the tines is adjusted by a grinding wheel, which can be moved from the heel and over a portion of each tine to adjust the melody of the comb. A plate cover serves to conceal the machined portions of each tine. However, there is nothing described as regards machining the tines from the heel in order to avoid any dissonance when one of the tines is actuated, which constitutes a drawback.

CH Patent No. 498 463 discloses a musical comb. This musical comb includes several rectilinear tines connected to a heel and forming one piece with the heel. The heel also includes grooves in the extension of the spaces between the tines. However, there is nothing described as regards machining the tines from the body in order to avoid any dissonance when one of the tines is actuated, which constitutes a drawback.

JP Patent Application No. 2001-215956 discloses a musical comb with tines parallel to one another and grooves made in the heel. However, there is nothing described as regards machining the tines from the heel in order to avoid any dissonance when one of the tines is actuated, which constitutes a drawback.

SUMMARY OF THE INVENTION

It is therefore an object of the invention to overcome the drawbacks of the state of the art by providing an optimised musical comb for a timepiece striking mechanism, in order to avoid any vibration transfer from an actuated tine to the adjacent tines and to prevent generating a dissonant sound.

The invention therefore concerns an optimised musical comb suitable for a striking mechanism of a timepiece, the musical comb comprising several tines connected to a heel for securing the comb inside the timepiece, the musical comb includes grooves in the heel each extending in the extension of each space between the adjacent tines, the tines being rectilinear and arranged parallel to one another in a same plane from the heel, wherein each tine is obtained by machining with a symmetry between points of connection on the heel relative to a bending plane of each tine to be actuated.

One advantage of the optimised musical comb for a striking mechanism according to the invention lies in the fact that in the extension of the spaces between each tine, grooves are made in the heel, which makes it possible to separate the tines from each other and limit vibration transfer from one tine to another. Moreover, this also very precisely limits stresses to the point of attachment between the actuated tine and the heel. Indeed, when a tine is actuated, the bending of the tine produces a stress at the point of attachment of the tine, but because of the grooves in the heel, the stress is not sufficient to prestress the adjacent tines, which therefore remain inactive.

Advantageously, during manufacture of such an optimised musical comb, each tine is machined individually with a round or cylindrical milling cutter to obtain a symmetry between the points of connection to the heel relative to the bending plane of the tine. Thus, the first bending mode is perfectly actuated when an actuation pin bends a tine as it passes. The transmitted energy, in the first bending mode, is thus maximal. The same is true of the vibration amplitude, which is also maximum, which has the effect of increasing the acoustic level of the melody and the perception of sound.

The invention also concerns a method for manufacturing an optimised musical comb suitable for a timepiece striking mechanism, wherein the method includes the steps of:

providing an initial preform having the shape of a heel extended perpendicularly from one side by a flat portion of smaller thickness than the thickness of the heel, machining tines in the flat portion with an identical space between each pair of adjacent tines and a different or partly different length of each tine from the heel, and with a symmetry between points of connection to the heel relative to a bending plane of each tine to be actuated, and machining grooves in the heel each in the extension of the spaces between two adjacent tines.

BRIEF DESCRIPTION OF THE DRAWINGS

The objects, advantages and features of the musical comb for a timepiece striking mechanism, and of the method for manufacturing the musical comb will appear more clearly in the following description, particularly with reference to the drawings, in which.

DETAILED DESCRIPTION OF THE INVENTION

In the following description, all those parts of a timepiece striking mechanism provided with at least one musical comb, which are well known in this technical field, will only be briefly described.

Figure 1A:
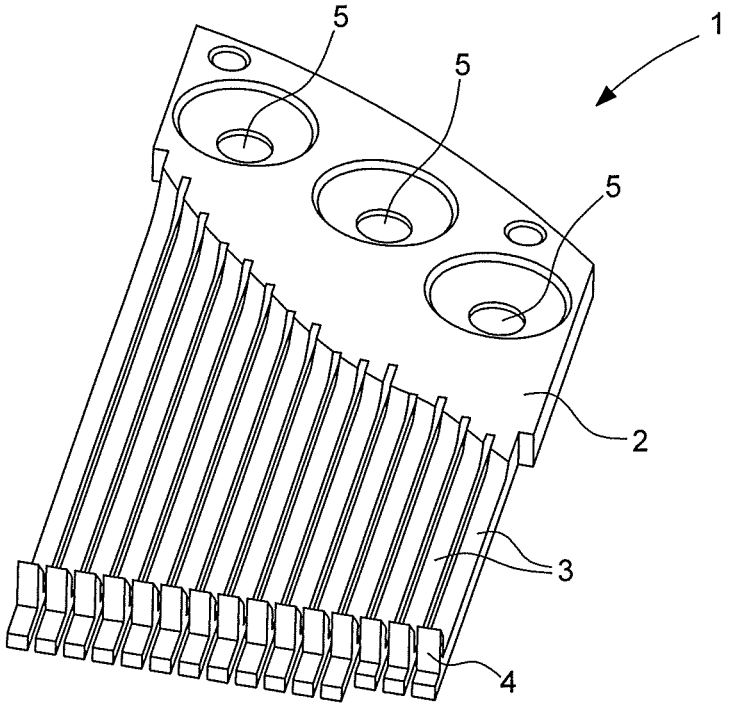
Fig. 1a (Prior art)
FIGS. 1*a* and 1*b* described above represent a three-dimensional view and a top view of an embodiment of a prior art musical comb for a striking mechanism.
Figure 1B:
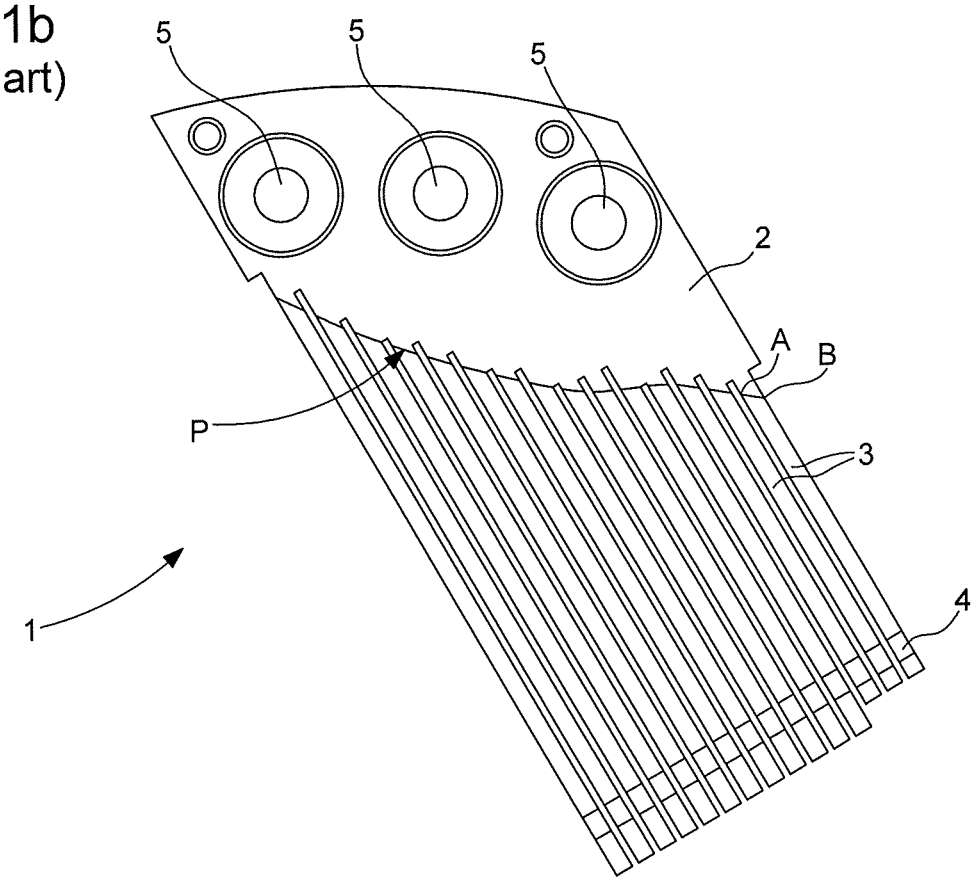
Fig. 1b (Prior art)
Figure 2A:
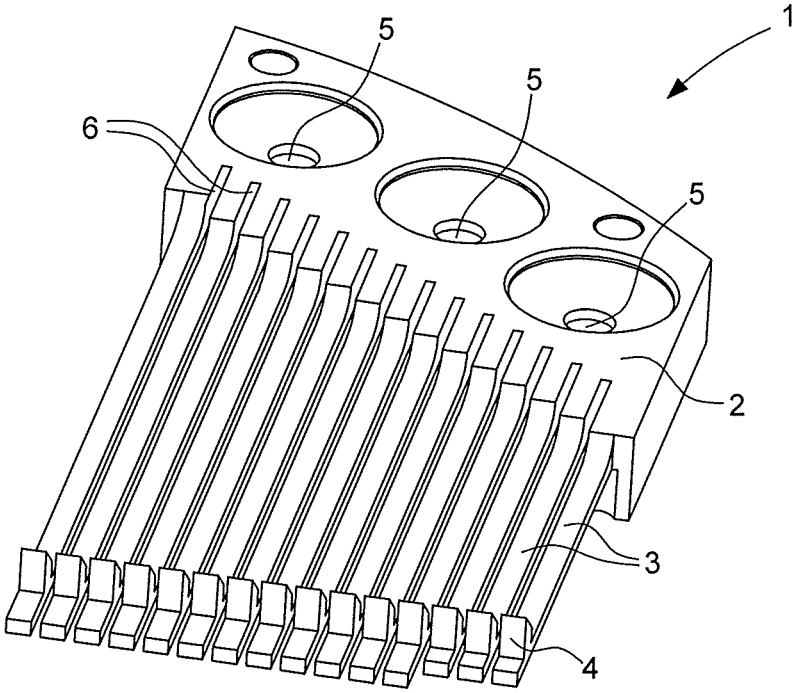
FIGS. 2*a* and 2*b* show a three-dimensional view and a top view of an embodiment of an optimised musical comb for a striking mechanism according to the invention.
Figure 2B:
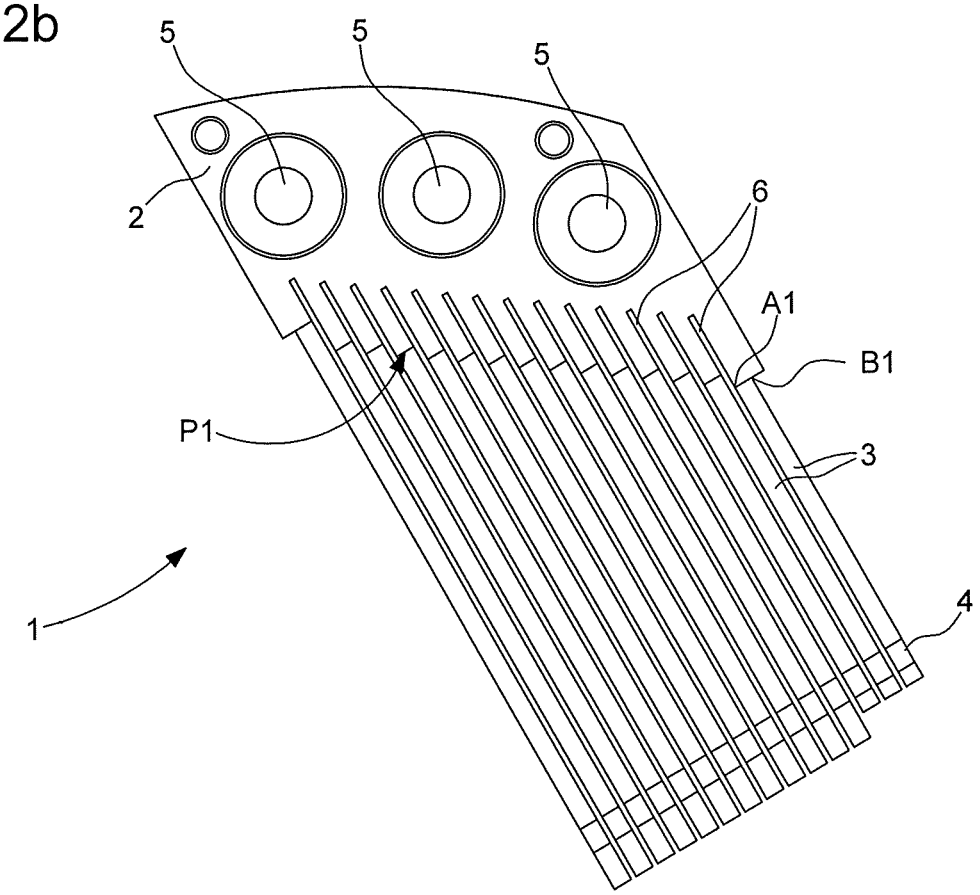

FIGS. 2*a* and 2*b* represent an embodiment of a musical comb 1 for a musical module of a striking mechanism. Comb 1 includes a set of tines 3 which may be rectilinear. These tines 3 can be arranged parallel to one another in the same plane. The space between each tine 3 may be identical. One end of each tine is fixed to a same heel 2. Heel 2 has holes 5 for the passage of screws (not represented) in order to fix heel 2, for example, to a bridge connected to a plate, or directly to a plate or a middle part inside the case of a timepiece, such as a musical watch. Preferably, tines 3 are integral with heel 2, so as to form a single part made of the same material, i.e. a one-piece musical comb 1. The material may be, for example, a metal material, such as steel or copper, or a precious metal, such as gold or platinum, or also an amorphous structure material, such as metallic glass.

To actuate tines 3 of musical comb 1, there may be provided a cam 4, which defines a ramp, at a free end of each tine 3. The ramp of cam 4 preferably forms a slope defining an acute angle relative to the free end of tine 3. An actuation member, such as a pin, can come into contact with the ramp of cam 4 so as to lift or bend the corresponding tine 3. Each actuation pin of the corresponding tine 3 may be located, for example, on a cylinder or disc of the striking mechanism. Generally, actuation of each tine by cam 4 is achieved by moving a respective pin in a plane parallel to tines 3 and in the direction of the free end of the tine 3 to be actuated. Once the actuation member, i.e. the pin, has moved beyond said cam 4, tine 3 is released so that it starts to vibrate and emits a specific note, defined in particular by its length from heel 2.

A rectilinear part of the tine, which lies behind each cam 4 on the free end side of each tine 3, is required for the frequency tuning of musical comb 1. Musical comb 1 is dimensioned to have tines 3, whose fundamental frequencies remain lower than the desired frequencies that form the melody or the chime. Removing material from this end makes it possible to increase the frequency of each tine 3 and therefore to precisely tune each tine to within 5 Hz. This adjustment of the length of each tine 3 avoids any adjustment of the thickness of tine 3 in the event that the frequency of tine 3 is higher than the desired frequency. The thickness adjustment would reduce the stiffness of each tine 3. The energy stored during bending of tine 3 would be lower, as would the acoustic level.

According to the invention, at the point of attachment of tines 3 to heel 2, i.e. at the place where tines 3 are joined to heel 2, grooves 6 are arranged in heel 2, extending into the extension of each space between the adjacent tines 3. Preferably, the width of each groove 6 can be identical to the space between two adjacent tines 3. Each groove 6 can be made rectilinear and along the direction of the corresponding space between two adjacent tines 3. The depth of each groove 6 may be identical to the thickness of each tine 3, or greater to avoid any vibration transfer from one tine 3 to another adjacent tine 3 during actuation of said tines. The thickness of heel 2 may be chosen to be between two and ten times greater than the thickness of each tine 3. Grooves 6 may also be made throughout the entire thickness of heel 2.

This thickness of heel 2 is necessary for the conditions of each tine 3 to be defined as a clamped beam. Without this extra thickness of heel 2, i.e. if it had a similar thickness to that of tines 3 or of grooves 6, the stiffness of each tine 3 would be reduced. Thus, the assembly consisting of heel 2 and tines 3 up to the end of each groove 6 would undergo a deformation during actuation of each tine 3. The thickness of the heel also makes it possible to have a bearing surface with the plate or the external parts of the timepiece while allowing tines 3 to vibrate freely. Without heel 2, and because each tine 3 is attached at different locations according to the length of the various tines 3, some tines 3 would be in direct contact with the plate or case middle. This would prevent the actuated tine 3 from vibrating properly and would increase dampening.

To make musical comb 1, it is possible to choose a preform that already includes the shape of a heel 2 extended perpendicularly from one side by a flat portion of smaller thickness where the tines are to be made. An upper surface of the flat portion is in an extension parallel to an upper surface of heel 2.

Tines 3 of musical comb 1 are thus machined individually from their free end to their point of attachment to heel 2. The spaces between two adjacent tines 3 are made by a machining tool which may be, for example a milling cutter or a wire cutter. Grooves 6 in heel 2 can be obtained directly by the machining tool after each space between two adjacent tines, or at the end of the machining of musical comb 1. The thickness of each tine 3 and cam 4 of the free end of each tine 3 is adjusted by a milling operation, particularly by means of a round or cylindrical milling cutter.

At the point of attachment of each tine 3 to heel 2, as shown in FIG. 2*b*, this type of machining produces a symmetry between points A1 and B1 relative to the bending plane of tine 3 connected to heel 2. Each line P1 connecting points A1 and B1 is perpendicular to the direction of each tine 3. Thus, the first bending mode is perfectly actuated when a pin bends tine 3 as it passes. The transmitted energy, in the first bending mode, is maximal. The vibration amplitude is also maximum, which has the effect of increasing the acoustic level of the melody and the perception of sound.

It is also to be noted with regard to grooves 6 in heel 2 of musical comb 1 that they are intended to separate the tines 3 from each other and to limit vibration transfer from one tine 3 to another adjacent tine 3. Indeed, when a tine 3 is actuated, for example bent by a pin, the bending of tine 3 produces a stress at the point of attachment of tine 3 to heel 2. These grooves 6 avoid coupling between tines 3 of musical comb 1 and very precisely limit the stresses to the point of attachment of each actuated tine 3. Grooves 6 prevent a normal movement being imparted to the adjacent tines. The melody produced by musical comb 1 in this configuration of the present invention can be considered pure and free of sound interference or dissonance.

Figure 3A:
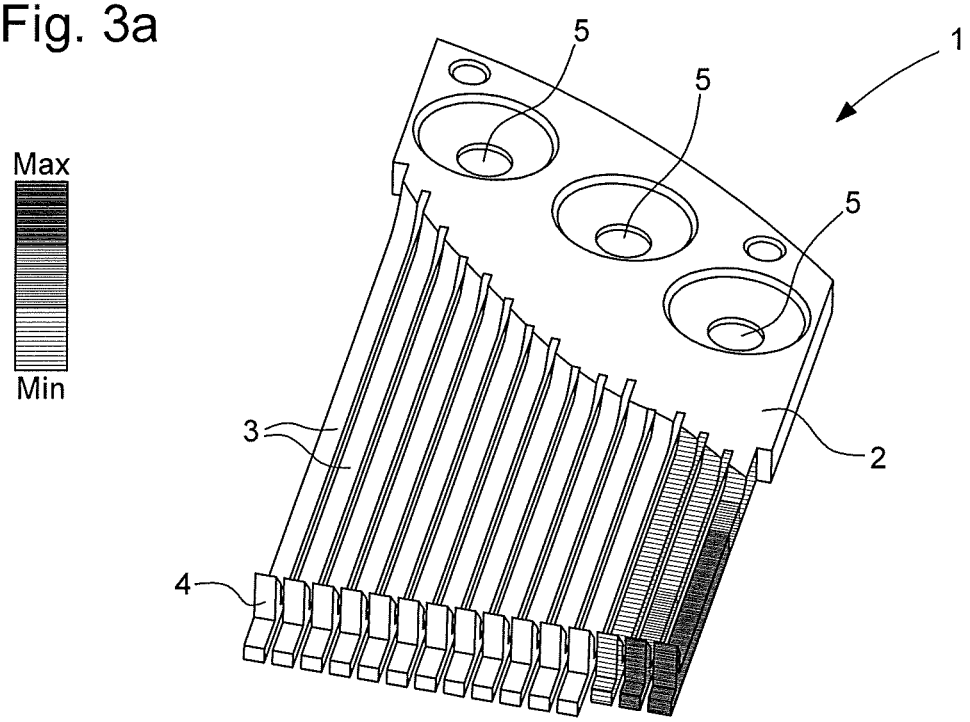
FIGS. 3*a* and 3*b* represent a comparison between a conventional musical comb producing sound interference at each actuation of a tine and an optimised musical comb according to the invention without sound interference at each actuation of a tine.
Figure 3B:
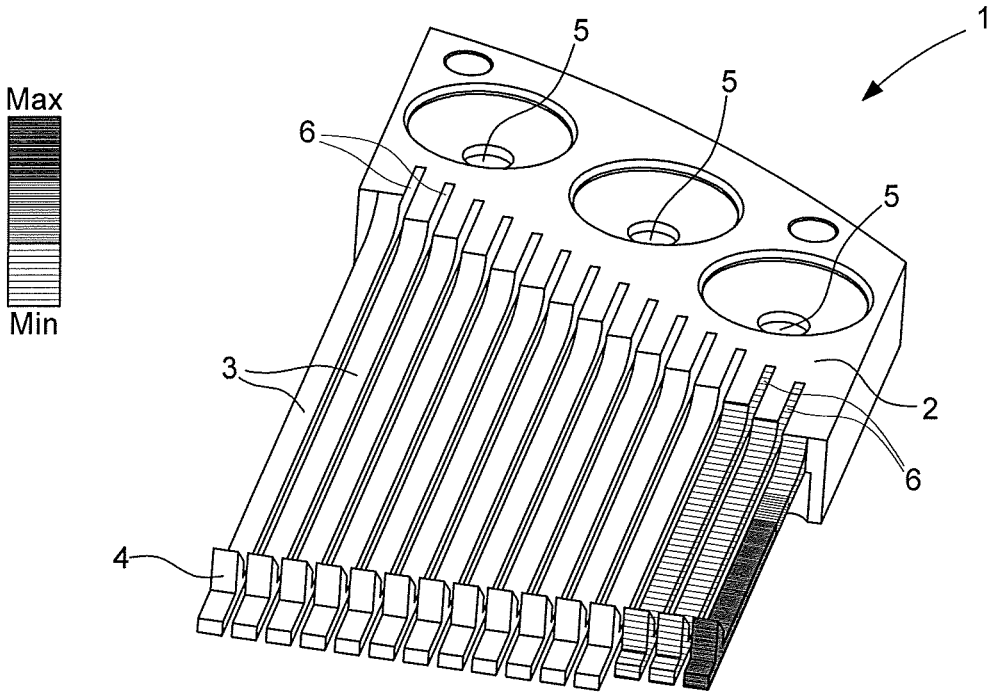

For comparative purposes, FIGS. 3*a* and 3*b* represent a comparison, during actuation, for example, of the tine 3 having the highest-pitched sound, between a conventional musical comb 1 in FIG. 3*a* and an optimised musical comb 1 with grooves 6 according to the invention in FIG. 3*b*. Following bending of the highest-pitched tine 3, which is the smallest tine 3, it is noted that the actuated tine 3 vibrates after passage of the pin. The same applies to the tines 3 adjacent to the actuated tine 3 in the case of the conventional musical comb 1, which also undergo a bending motion, which is not the case of optimised musical comb 1 with grooves 6. A vibration scale from Min to Max is provided and represented on the three tines 3 of the conventional musical comb 1 and the optimised musical comb 1 without generating dissonance, since the two tines 3 adjacent to the highest-pitched actuated tine 3 normally do not vibrate.

From the description that has just been given, several variants of the musical comb for a timepiece striking mechanism can be devised by those skilled in the art without departing from the scope of the invention defined by the claims. Each tine may be of rectilinear shape with a rectangular or circular or other cross-section, which may be identical over the entire length of the tine. The cross-section may also vary gradually or discontinuously along the length of each tine.

The invention claimed is:

1. A musical comb suitable for a striking mechanism of a timepiece, the musical comb comprising several tines connected to a heel for securing the comb inside the timepiece, the musical comb including grooves in the heel each extending in an extension of a space between each adjacent tine, the tines being rectilinear and arranged parallel to one another in a same plane from the heel, wherein each tine is obtained by machining with a symmetry between points of connection to the heel relative to a bending plane of each tine to be actuated.

2. The musical comb according to claim 1, wherein said tines are integral with the heel to form a single one-piece part made of the same material.

3. The musical comb according to claim 1, wherein said tines are all or partly of different length from the heel to a free end so that each generates a specific note when actuated.

4. The musical comb according to claim 1, wherein each tine comprises, in proximity to a free end, a cam, which forms a ramp to allow an actuation member of the striking mechanism to actuate said tine during passage of the ramp.

5. The musical comb according to claim 4, wherein a rectilinear part of each tine, which lies behind each element on the free end side of each tine, allows frequency tuning of the musical comb to be achieved by reducing the tine length.

6. The musical comb according to claim 1, wherein the depth of each groove in the heel is identical to or greater than the thickness of each tine.

7. The musical comb according to claim 1, wherein said grooves in the heel are also made throughout the entire thickness of the heel.

8. The musical comb according to claim 1, wherein said thickness of the heel is between 2 and 10 times greater than the thickness of each tine.

9. A method for manufacturing a musical comb suitable for a timepiece striking mechanism, wherein said method comprises the steps of:

providing an initial preform having the shape of a heel extended perpendicularly from one side by a flat portion of smaller thickness than the thickness of the heel, machining tines in the flat portion with an identical space between each pair of adjacent tines and a different or partly different length of each tine from the heel, and with a symmetry between points of connection to the heel relative to a bending plane of each tine to be actuated, and machining grooves in the heel each in an extension of the spaces between two adjacent tines.

10. The method for manufacturing a musical comb according to claim 9, wherein said tines are machined individually from their free end to their point of attachment to the heel.

11. The method for manufacturing a musical comb according to claim 9, wherein said spaces between each pair of adjacent tines are made by milling or by wire cutting.

12. The method for manufacturing a musical comb according to claim 9, wherein said machining of the tines from the heel to their free end is performed with a round or cylindrical milling cutter in order to obtain a symmetry between the points of connection to the heel relative to a bending plane of each tine to be actuated, and wherein each tine comprises, in proximity to a free end, a cam, the thickness of the tines and each cam at the free end of each tine is achieved by milling with a round or cylindrical cutter.

* * * * *